US005197672A

United States Patent [19]

Grytz et al.

[11] Patent Number: 5,197,672

[45] Date of Patent: Mar. 30, 1993

[54] FUEL INJECTION VALVE AND ADJUSTABLE GAS SLEEVE FORMING AN ANNULAR METERING GAS GAP

[75] Inventors: Uwe Grytz; Waldemar Hans, both of Bamberg; Frank Rudolf, Neustadt/Coburg, all of Fed. Rep. of Germany

[73] Assignee: Robert Bosch GmbH, Stuttgart, Fed. Rep. of Germany

[21] Appl. No.: 871,141

[22] Filed: Apr. 20, 1992

[30] Foreign Application Priority Data

Apr. 19, 1991 [DE] Fed. Rep. of Germany ..... 4112853

[51] Int. Cl.[5] ..... F02M 57/00; F02M 69/04; F02M 65/00

[52] U.S. Cl. ..... 239/1; 239/409; 239/417.3; 239/424; 239/426; 239/585.5

[58] Field of Search ..... 239/1, 5, 408, 409, 239/417.3, 423, 424, 426, 433, 434, 585.3–585.5, 533.12; 123/531

[56] References Cited

U.S. PATENT DOCUMENTS

| | | | |
|---|---|---|---|
| 3,680,794 | 8/1972 | Romann et al. | 239/585.4 |
| 4,545,354 | 10/1985 | Jaggle et al. | 123/470 |
| 5,088,467 | 2/1992 | Mesenich | 123/531 |
| 5,129,381 | 7/1992 | Nakajima | 239/533.12 |

*Primary Examiner*—Andres Kashnikow
*Assistant Examiner*—Karen B. Merritt
*Attorney, Agent, or Firm*—Edwin E. Greigg; Ronald E. Greigg

[57] ABSTRACT

A device and method for injecting a fuel-gas mixture. The novel device has an advantage of a simple and exact adjustment of an annular gas gap. The adjustment of the axial extension of a narrow annular gap is effected by varying the axial spacing between the face end of a retaining shoulder on a fuel injection valve and the face end of the bottom part in the region of the annular gas gap of the gas enveloping bushing. The proposed device for injecting a fuel-gas mixture is especially suitable for injection into the intake tube of a mixture-compressing internal combustion engine with externally supply ignition.

13 Claims, 2 Drawing Sheets

FUEL INJECTION VALVE AND ADJUSTABLE GAS SLEEVE FORMING AN ANNULAR METERING GAS GAP

BACKGROUND OF THE INVENTION

The invention is based on a method for adjusting an annular gas gap for metering the gas, of a device for injecting a fuel-gas mixture. German Offenlegungsschrift 32 40 554 already discloses a device for injecting a fuel-gas mixture, which relates to a fuel injection valve having a gas guide sleeve surrounding the valve end of the fuel injection valve. A narrow annular gas gap is formed between one end of the valve and the gas guide sleeve and serves to meter the delivered gas, striking the fuel, and communicates with an annular gas conduit. Adjusting the quantity of gas delivered by the annular gas conduit and thus adapting the annular gas conduit to the requirements of the engine and to various types of injection valves is possible in this device only by displacing or bending the gas guide sleeve. This expensive method for adjusting the device entails high production costs, in large-scale mass production.

OBJECT AND SUMMARY OF THE INVENTION

The method according to the invention has an advantage which permits a simple and exact adjustment of the annular gas gap that meters the gas. By using different gas enveloping bushings, which have different, defined axial depths between the stop end of the cylinder part, remote from the bottom part, and the face end of the bottom part in the region of the narrow annular gas gap, the device according to the invention can be produced in a simple and economical manner.

The simple structure and the fact that different bushings can be used for various fuel injection valves also contribute to economical production of the gas enveloping bushing.

In order to join the gas enveloping bushing and the fuel injection valve in a manner that is simple to effect, solid and reliable, it is especially advantageous if the gas enveloping bushing is joined to the circumference of the nozzle body of the fuel injection valve by adhesive bonding.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
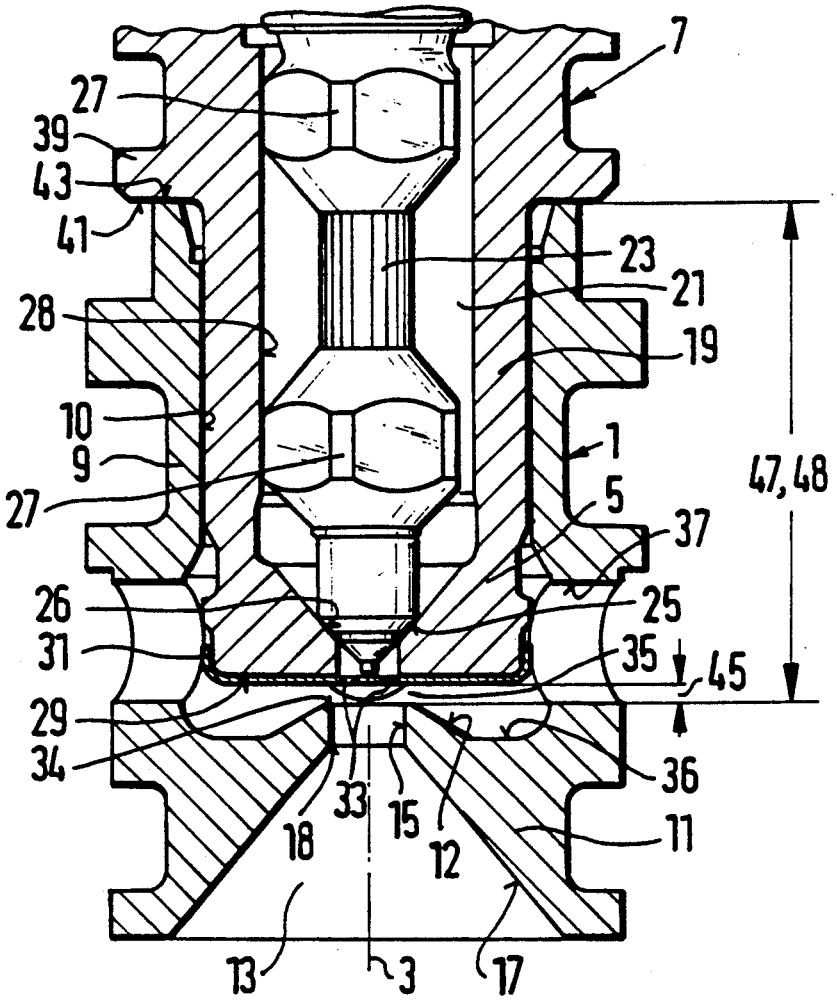
FIG. 1 is a fragmentary partial cross-sectional view of a first exemplary embodiment of the device according to the invention.

The device, shown in fragmentary form in FIG. 1, for injecting a fuel-gas mixture in accordance with the first exemplary embodiment can be mounted for instance in an injection valve receptacle of an intake tube of a mixture-compressing internal combustion engine with externally supplied ignition. The device according to the invention comprises a cup-shaped gas enveloping bushing 1, likewise shown in FIG. 2, which surrounds a valve end 5 of a fuel injection valve 7 concentrically with a longitudinal valve axis 3. A cylindrical part 9 of the gas enveloping bushing 1, includes a receiving opening 10 which axially at least partly surrounds the valve end 5 of the fuel injection valve 7, which is also at least partly radially surrounded by a bottom part 11 of the gas enveloping bushing 1 by its face end toward the valve end 5. Concentric with the longitudinal valve axis 3, the bottom part 11 of the gas enveloping bushing 1 has a mixture injection port 13, which on its end toward the valve end 5 of the fuel injection valve 7 has a cylindrical parallel segment 15 and an adjoining diffuser segment 17 remote from the valve end 5 which widens frustoconically in the direction of the fuel-gas mixture flow. The parallel segment 15 and the diffuser segment 17 border one another by means of an edge 18. The fuel injection valve 7, shown in fragmentary form and by way of example in FIG. 1, has a nozzle body 19 extending as far as the valve end 5. A stepped longitudinal opening 21 is formed in the nozzle body 19, concentric with the longitudinal valve axis 3. A valve needle 23 is disposed in the longitudinal opening 21 and cooperates, by its one sealing segment 25 oriented toward the bottom part 11 of the gas enveloping bushing 1 and tapering frustoconically in the fuel flow direction, with a fixed valve seat 26 of the longitudinal opening 21 in the nozzle body 19, the valve seat tapering frustoconically in the fuel flow direction. The valve needle 23 has guide segments 27, for instance two in number, which together with a guide region 28 of the longitudinal opening 21 of the nozzle body 19 serve to guide the valve needle 23 in the longitudinal opening 21. The valve needle 23 is electromagnetically actuatable, for instance, in a known manner.

On a face end 29 of the nozzle body 19 oriented toward the bottom part 11 of the gas enveloping bushing 1, a perforated disk 31 is for instance disposed, which has injection ports 33, for instance two in number, which for instance may be inclined radially outward in the direction of fuel flow with respect to the longitudinal valve axis 3 and serve to inject the fuel.

A narrow, radially extending annular gas gap 35 is formed in the direction of the longitudinal valve axis 3 between the valve end 5 of the fuel injection valve 7 and the bottom part 11 of the gas enveloping bushing 1. In the first exemplary embodiment, shown in FIGS. 1 and 2, the narrow annular gas gap 35 extends axially between the perforated disk 31 of the valve end 5 and the peripheral region 34 of the face end 12 of the bottom part 11, which region extends parallel to the perforated disk 31 and for instance directly surrounds the mixture injection port 13. The annular gas gap 35 serves to deliver the gas to the fuel, the fuel having been injected through the injection ports 33 of the fuel injection valve 7, and serves to meter the gas for a gas fuel mixture.

In the bottom part 11 of the gas enveloping bushing 1, toward the valve end 5 of the fuel injection valve 7, an annular recess 36 that extends in the direction remote from the valve end 5 is formed between the annular gas gap 35 and the wall of the receiving opening 10 of the cylindrical portion 9; this recess enables a more-uniform inflow of the gas through the annular gas gap 35 to the mixture injection port 13.

The cylindrical portion 9 of the gas enveloping bushing 1 has, for instance four, gap delivery openings on its circumference; they extend through the wall of the cylindrical portion 9 as far as the inside of the receiving opening 10. The gas delivery openings 37 communicate with the annular gas gap 35 and serve to deliver the gas to the mixture injection port 13. Other possibilities for the cross section of the gas delivery opening 37, besides the circular one shown in the exemplary embodiments, are rectangular, oval or other shapes. The aspirated air diverted through a bypass upstream of a throttle valve in the intake tube of the engine may be used as the gas, or air fed by an additional blower, or recirculated engine exhaust gas, or a mixture of air and exhaust gas. The use of recirculated exhaust gas makes it possible to reduce the toxic emissions from the engine.

At the circumference of the nozzle body 19 of the valve end 5, remote from the perforated disk 31, an encompassing retaining shoulder 39 is formed, pointing radially outward. The retaining shoulder 39 has a face end 41 toward the perforated disk 31. With a stop face end 43 of the cylindrical portion 9 remote from the bottom part 11, the gas enveloping bushing 1 rests on the face end 41 of the retaining shoulder 39 of the nozzle body 19. The contact of the stop face end 43 of the gas enveloping bushing 1 on the retaining shoulder 39 of the nozzle body 19 of the fuel injection valve 7 predetermines an axial extension 45 of the narrow annular gas gap 35 in the direction of the longitudinal valve axis 3. The gas delivered through the gas delivery openings 37 and through the space formed between the valve end 5 or perforated disk 31 and the bottom part 11 flows through the narrow annular gas gap 35 to the mixture injection port 13, where it meets the fuel injected through the injection ports 33. Because of the slight axial extension of the narrow annular gas gap 35 in the direction of the longitudinal valve axis 3, the delivered gas is accelerated strongly and atomizes the fuel particularly finely, thereby reducing toxic engine emissions.

For the sake of obtaining a maximally homogeneous fuel-gas mixture, which enables optimal combustion, the quantity of the gas meeting the injected fuel must match a predetermined set-point quantity. The axial extension 45 of the narrow annular gas gap 35 must accordingly be of a predetermined dimension.

To adjust the quantity of the gas flowing through the annular gas gap 35, with the gas enveloping bushing 1 seated on the fuel injection valve 7 and resting by its stop face end 43 on the face end 41 of the retaining shoulder 39, a first method step according to the invention provides that the actual quantity of gas flowing through the annular gas gap 35 is measured by means of a flow rate meter. An axial spacing 47 between the face end 41 of the retaining shoulder 39 and the horizontal peripheral region 34 immediately surrounding the mixture injection port 13 is brought about; after this first method step, this spacing is equal to an axial depth 48 from the stop face end 43 of the cylindrical portion 9 up to the peripheral region 34. In a second method step of the invention, the set-point quantity of the delivered gas is adjusted, by varying the axial spacing 47 between the face end 41 of the retaining shoulder 39 and the peripheral region 34, immediately surrounding the mixture injection port 13, of the face end 12 of the bottom part 11; as a result, the axial extension 45 of the annular gas gap 35 is varied until such time as the measured actual quantity of the gas matches the predetermined set-point quantity.

In order to vary the axial spacing 47 between the face end 41 and the peripheral region 34 of the bottom part 11 at the face end 12, the extension of the cylindrical portion 9 in the direction of the longitudinal valve axis 3 can be reduced, by removing material from the stop face end 43 until the axial depth 48 is equal to the necessary axial spacing 47. However, it is also possible to vary the axial spacing 47 by reducing the axial extension of the bottom part 11, beginning at the face end 12 in the direction of the longitudinal valve axis 3, at least in the region of the narrow annular gas gap 35. If the measured actual quantity of the gas flowing through the annular gas gap 35 matches the predetermined set-point quantity, when the cylindrical portion 9 of the gas enveloping bushing 1 rests by its stop face end 43 on the retaining shoulder 39 of the nozzle body 19, then the gas enveloping bushing 1 is joined to the periphery of the nozzle body 19 of the fuel injection valve 7, for instance by means of adhesive bonding.

To simplify the adjusting method it is advantageous to adjust the axial extension 45 of the annular gas gap 35 by pairing the fuel injection valve 9 with a predetermined gas enveloping bushing 1, which has a defined axial depth 48 between the stop face end 43 and the face end 12 of the bottom part 11, and which can be selected from a plurality of gas enveloping bushings 1 that have various defined axial depths 48. The defined axial depth 48 is then equal to the axial spacing 47 required for the set-point quantity.

Figure 2:
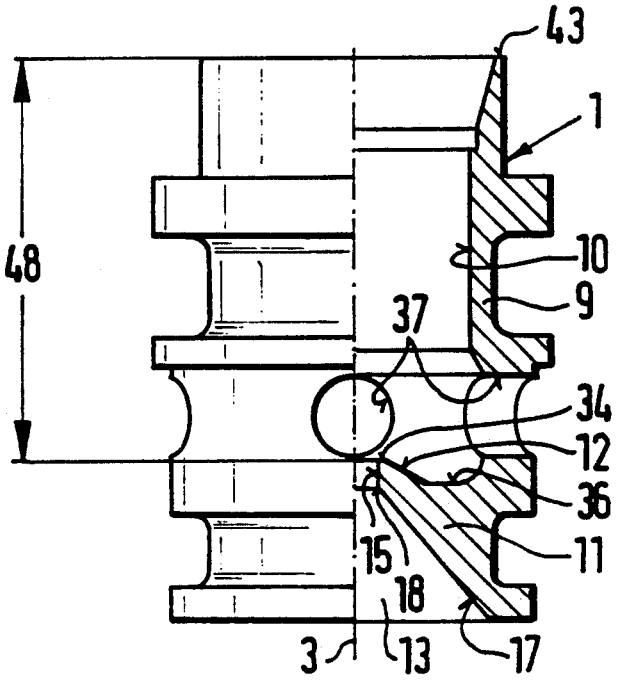
FIG. 2 shows a partial cross-sectional view of a gas enveloping bushing in accordance with the first exemplary embodiment.
Figure 3:
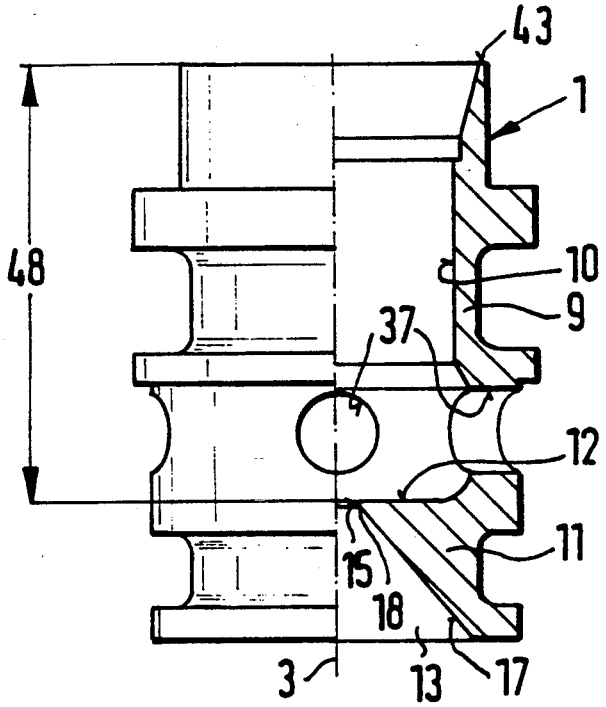
FIG. 3 shows a partial cross-sectional view of a gas enveloping bushing for a device in accordance with a second exemplary embodiment.

FIG. 3 shows a gas enveloping bushing 1 for a device in accordance with a second exemplary embodiment. Elements that are the same and function the same are identified by the same reference numerals as in FIGS. 1 and 2. In contrast to the first exemplary embodiment, the bottom part 11 of the gas enveloping bushing 1 is embodied at its face end 12 in the radial direction between the gas injection port 13 and the wall of the receiving opening 10 of the cylindrical portion 9 as flat over the same height, so that in the direction of the longitudinal valve axis 3, for instance between the perforated disk 31 of the valve end 5 and the face end 12 of the bottom part 11, a narrow annular gas gap 35 extending outward radially, over a wide range beginning at the mixture injection port 13, is formed, by way of which the delivery of the gas to the mixture injection port 13 takes place. Because of the flat face end 12 of the bottom part 11, any possible storage of some of the injected fuel in the gas enveloping bushing 1 is prevented, and all of the fuel injected through the injection ports 33 is entrained by the delivered gas. In this exemplary embodiment, the axial length of the parallel segment 15 of the mixture injection port 13 is reduced compared with the exemplary embodiment of FIGS. 1 and 2.

Figure 4:
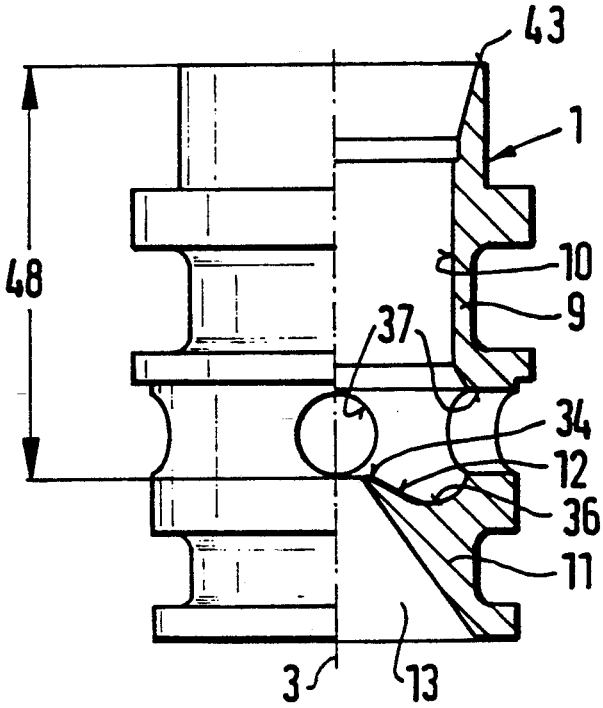
FIG. 4 shows a partial cross-sectional view of a gas enveloping bushing for a device in accordance with a third exemplary embodiment.

FIG. 4 shows a gas enveloping bushing 1 for a device according to the invention in a third exemplary embodiment; elements that are the same and function the same are identified by the same reference numerals as in FIGS. 1 to 3. In contrast to the first and second exemplary embodiments shown in FIGS. 1 to 3, in the third exemplary embodiment, the mixture injection port 13 widens continuously frustoconically immediately beginning at the face end 12, in the direction of the fuel-gas mixture flow. Accordingly, there is no parallel segment 15. As a result, the danger that fuel can deposit on the edge 18 between the parallel segment 15 and the diffuser segment 17 of the mixture injection port 13, and then drip off in the form of relatively large fuel droplets, which exists in the exemplary embodiments of FIGS. 1 to 3, can be avoided.

The method and the device according to the invention enable the simple and exact adjustment of the axial extension 45 of the narrow annular gas gap 35, which serves to deliver the gas to the mixture injection port 13 and to meter the gas.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A method for adjusting a narrow annular gas gap, which meters a set-point quantity of a gas, of a device for injecting a fuel-gas mixture, said device comprising a fuel injection valve with a nozzle body with a retaining shoulder on its circumference pointing radially outward with a face end, and a cup-shaped gas enveloping bushing with a stop face end and with a mixture injection port in a bottom part, said mixture injection port extending concentrically with a longitudinal axis, said bushing encompassing a valve end of the fuel injection valve at least partly axially with a cylindrical portion and at least partly radially with a face end of the bottom part, forming a narrow annular gas gap between the face end of the bottom part and the valve end of the fuel injection valve, with the stop face end (43) of the gas enveloping bushing (1) resting on the face end (41) of the retaining shoulder (39), the method comprising the steps of measuring an actual quantity of the gas flowing through the annular gas gap (35), adjusting the quantity of the gas flowing through the annular gas gap (35) by adjusting an axial spacing (47) between the face end (41) of the retaining shoulder (39) and the face end (12) of the bottom part (11) in the region of the annular gas gap (35) until the measured actual quantity of the gas matches a predetermined set-point quantity.

2. A method as defined by claim 1, in which to vary the axial spacing (47) between the face end (41) of the retaining shoulder (39) and the face end (12) of the bottom part (11), an axial depth (48), extending axially between the stop face end (43) of the gas enveloping bushing (1) resting on the face end (41) of the retaining shoulder (39) and the face end (12) of the bottom part (11) is reduced by removal of material from one of the stop face end (43) and the face end (12) of the bottom part.

3. A method as defined by claim 2, in which the gas enveloping bushing (1) is joined to the circumference of the nozzle body (19) of the fuel injection valve (7) by adhesive bonding.

4. A method as defined by claim 1, in which to vary the axial spacing (47) between the face end (41) of the retaining shoulder (39) and the face end (12) of the bottom part (11), an extension of the bottom part (11) in the direction of the longitudinal valve axis (3) is reduced, at least in the region of the annular gas gap (35), by removal of material from the face end (12) of the bottom part.

5. A method as defined by claim 4, in which the gas enveloping bushing (1) is joined to the circumference of the nozzle body (19) of the fuel injection valve (7) by adhesive bonding.

6. A method as defined by claim 1, in which the adjustment of the narrow annular gas gap (35) is effected by pairing the fuel injection valve (7) with a gas enveloping bushing (1) selected from a plurality of gas enveloping bushings (1), which selected bushing has a defined axial depth (48) between the stop face end (43) and the face end (12) of the bottom part (11), this depth being equal to the required axial spacing (47) for the set-point quantity of the gas.

7. A method as defined by claim 6, in which the gas enveloping bushing (1) is joined to the circumference of the nozzle body (19) of the fuel injection valve (7) by adhesive bonding.

8. A method as defined by claim 1, in which the gas enveloping bushing (1) is joined to the circumference of the nozzle body (19) of the fuel injection valve (7) by adhesive bonding.

9. A device for injecting a fuel-gas mixture, comprising, a fuel injection valve, said valve including a nozzle body, said nozzle body including a retaining shoulder pointing radially outward from its circumference, said retaining shoulder having a face end, a cup-shaped gas enveloping bushing, which encompasses a valve end of the fuel injection valve at least partly axially with a cylindrical portion and at least partly radially with a face end of a bottom part, said bushing including a mixture injection port in the bottom part extending concentrically with the longitudinal valve axis, and a narrow annular gas gap serving to meter the gas is formed between the face end of the bottom part and the valve end of the fuel injection valve, said cylindrical portion (9) of the ga enveloping bushing (1) includes a stop face end (43) remote from the bottom part (11) which rests on the face end (41) of the retaining shoulder (39) of the nozzle body (19).

10. A device as defined by claim 9, in which an axial extension (45) of the annular gas gap (35) is adjustable in a direction of the longitudinal valve axis (3) by means of a variation of an axial spacing (47) between the face end (41) of the retaining shoulder (39) and the face end (12) of the bottom part (11) in the region of the annular gas gap (35).

11. A device as defined by claim 9, in which the gas enveloping bushing (1) is joined to the circumference of the nozzle body (19) of the fuel injection valve (7) by means of adhesive bonding.

12. A device as defined by claim 9, in which the mixture injection port (13) widens frustoconically in a direction of the flow of the fuel-gas mixture.

13. A device as defined by claim 12, in which the mixture injection port (13), beginning at the face end (12) of the bottom part (11), has a cylindrical parallel segment (15) and adjoining it in the flow direction has a diffuser segment (17) that widens frustoconically in the flow direction.

* * * * *